United States Patent [19]

Sutherland et al.

[11] Patent Number: 4,852,268

[45] Date of Patent: Aug. 1, 1989

[54] LOTTERY TICKET TEMPLATE

[76] Inventors: Ronald G. Sutherland; Brenda A. Sutherland, both of General Delivery, Clandeboye, Manitoba, Canada, R0C 0P0

[21] Appl. No.: 200,440

[22] Filed: May 31, 1988

[51] Int. Cl.[4] ..... B42D 15/00; G07C 15/00

[52] U.S. Cl. ..... 33/562; 283/903; 434/364

[58] Field of Search ..... 33/562, 563; 283/903; 434/363, 364; 273/148 R

[56] References Cited

U.S. PATENT DOCUMENTS

| | | | |
|---|---|---|---|
| 1,781,047 | 11/1930 | Bondeson . | |
| 2,525,837 | 10/1950 | Simplair . | |
| 3,089,260 | 5/1963 | Gray . | |
| 3,141,683 | 7/1964 | Engelstein . | |
| 4,586,906 | 5/1986 | Buccieri, Jr. . | |
| 4,603,884 | 8/1986 | Burton . | |
| 4,752,073 | 6/1988 | Thompson | 434/353 |

FOREIGN PATENT DOCUMENTS

| | | | |
|---|---|---|---|
| 2721986 | 11/1978 | Fed. Rep. of Germany | 283/903 |
| 3127538 | 1/1983 | Fed. Rep. of Germany | 283/903 |

*Primary Examiner*—Harry N. Haroian

*Attorney, Agent, or Firm*—Murray E. Thrift; Stanley G. Ade; Adrian D. Battison

[57] ABSTRACT

A template is intended for use with user marked lottery tickets. The template consists of two sheets of stiff material joined along a fold line. The sheets conform in shape and size to the lottery ticket to be marked. One sheet of the template is provided with an array of perforations outlining removable areas on the template that correspond in number, position and form to the user markable spaces on the lottery ticket. The template is preferably a transparent plastic material. In use, the removable areas corresponding to numbers to be marked on the lottery ticket are removed from the template so that a writing implement may be introduced through the resulting open areas for marking the desired spaces on the ticket. The template may be used not only for marking a ticket but for protecting the ticket from damage so that it can be used from time to time.

2 Claims, 3 Drawing Sheets

LOTTERY TICKET TEMPLATE

FIELD OF THE INVENTION

The present invention relates to a template for lottery tickets and more particularly to a template for lottery tickets of the user marked type.

BACKGROUND

One type of lottery that has become increasingly popular provides a lottery player with the opportunity to select his or her own ticket number. This is done by providing the player with a blank ticket with one or more arrays of numbered rectangular boxes printed on the face of the ticket. The player marks the boxes containing the selected numbers and the marked ticket is machine read to generate a printed receipt for the ticket user.

It is the habit of many lottery players to use the same numbers repeatedly. The objective of the present invention is to facilitate this repeated playing of the same numbers.

SUMMARY

According to the present invention there is provided a template for use with a user marked lottery ticket comprising a sheet of stiff material with a plurality of perforations formed in the sheet of material to outline removable areas of the template, the removable areas corresponding in number, position and form to user markable spaces on the lottery ticket, and means for retaining the lottery ticket on the template with the user markable spaces in registry with respective removable areas of the template.

To use the template, the removable areas corresponding to the selected numbers are removed, the template is placed in registry with a ticket and the ticket is marked through the open areas of the template. Because the template is re-usable, marking a second or subsequent ticket with the same numbers is a relatively straight forward process.

In preferred embodiments of the invention, the template is formed as two sheets joined along a fold line so that a ticket may be kept between the two sheets. This means that a ticket may be retained and kept in good condition for re-use from time to time.

The template is preferably of a transparent material so that the complete ticket can be viewed through the material of the template.

BRIEF DESCRIPTION OF THE DRAWINGS

In the accompanying drawings which illustrate exemplary embodiments of the present invention.

DETAILED DESCRIPTION

Figure 1:
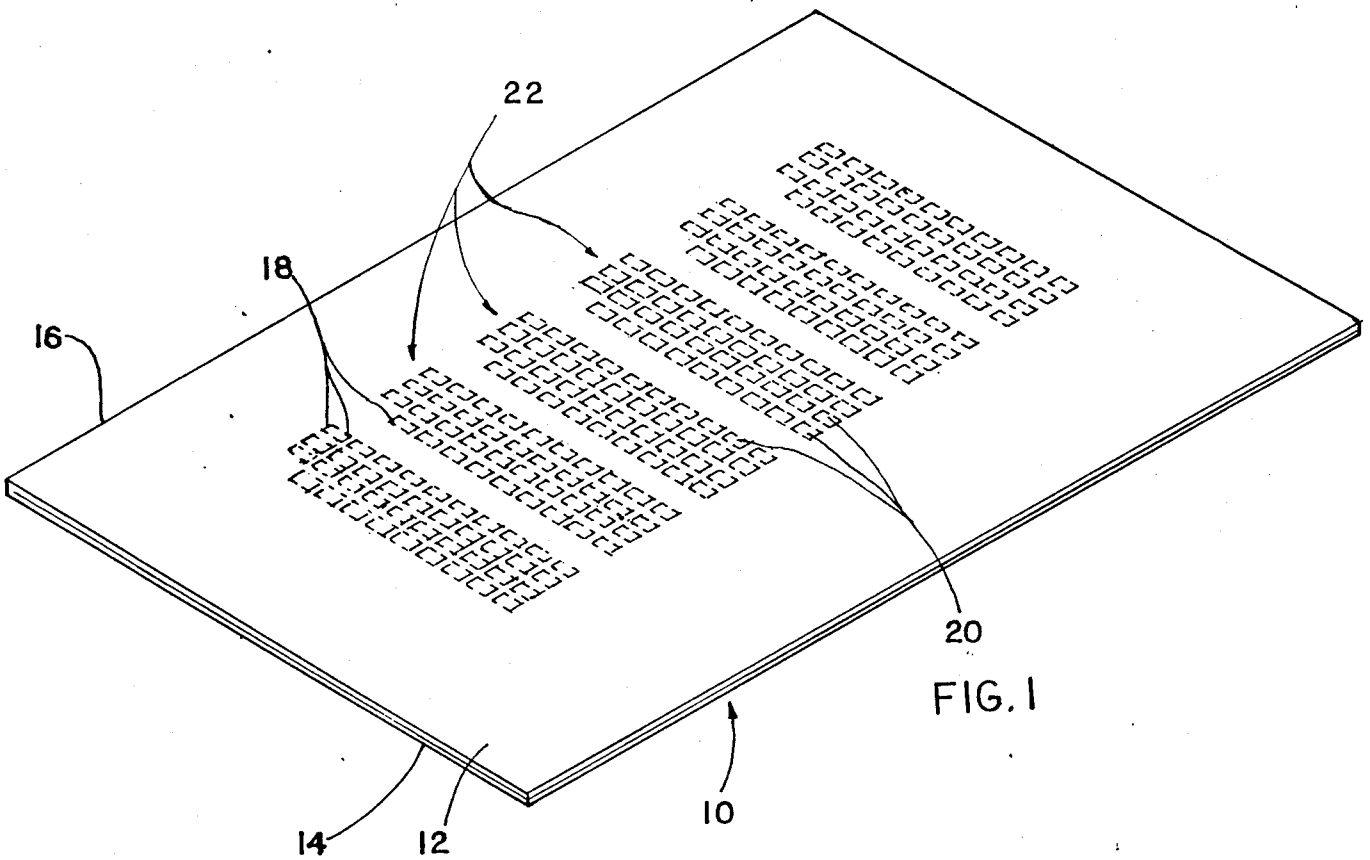
FIG. 1 is an isometric view of a template according to the present invention.
Figure 3:
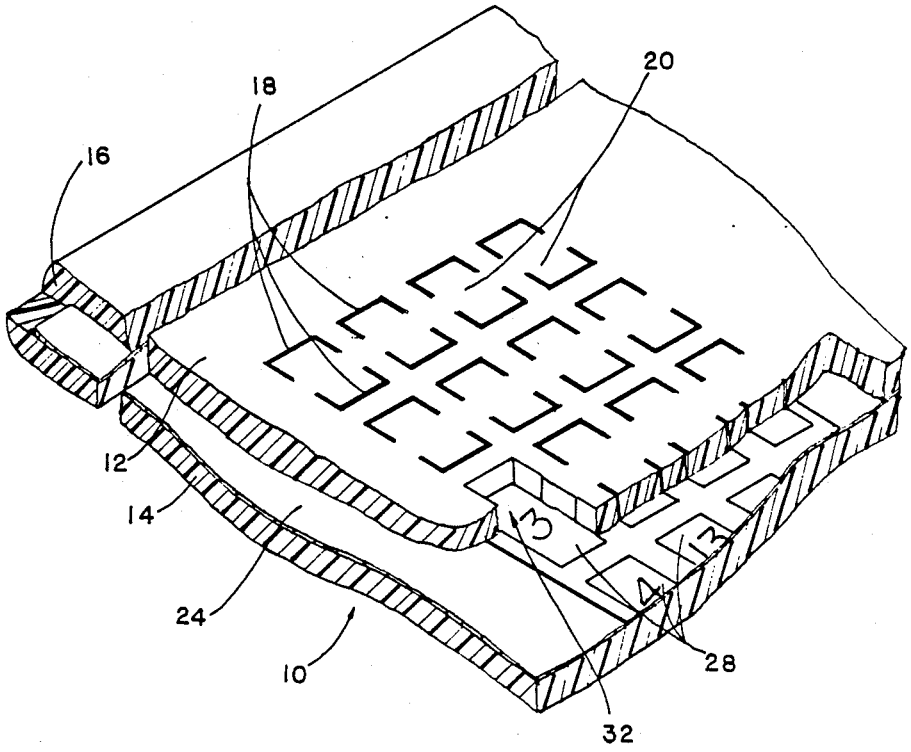
FIG. 3 is an enlarged partial view, partially broken away of the template of FIG. 1.

Referring to the accompanying drawings, and especially to FIGS. 1 and 3, there is illustrated a template 10 that includes a top sheet 12 of transparent plastic material and a bottom sheet 14 of the same material. The two sheets are of the same size and lie on top of one another. They are joined along a fold line 16 so that the two sheets can be separated. The top sheet 12 has a number of U-shaped perforations 18 through it, with the perforations arranged in opposed pairs to define removable rectangular areas 20. The areas may be removed by breaking the remaining plastic between the opposed ends of the U-shaped perforations.

Figure 2:
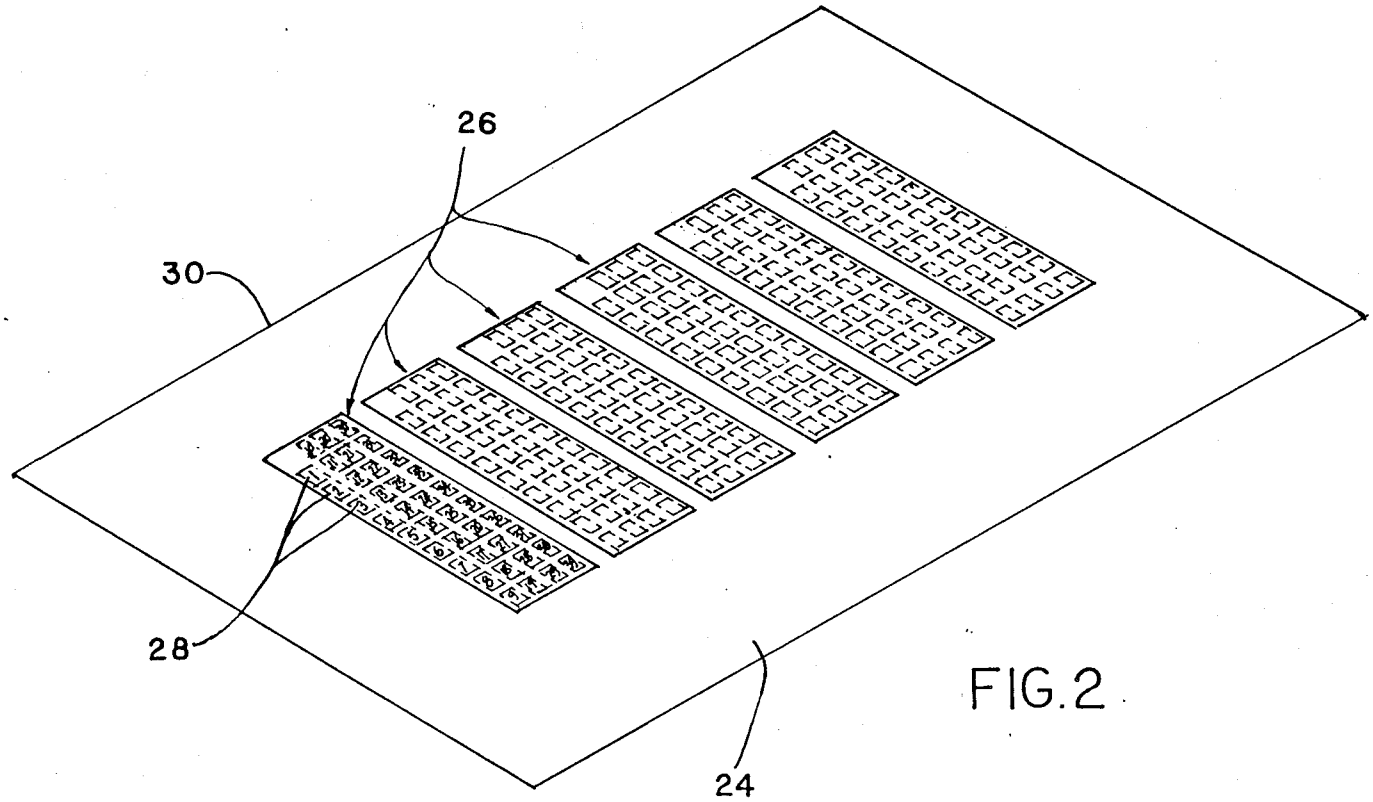
FIG. 2 is an isometric view of a ticket for use with the template of FIG. 1.

In the illustrated embodiment, the removable rectangular areas 20 are arranged in groups 22 as a generally rectangular array. This matches the array of numbers of the face of a lottery ticket 24 as illustrated in FIG. 2. The illustrated ticket has six groups twenty-six of thirty-nine numbered spaces 28 which corresponding number, position and form to the removable rectangular areas 20. The ticket 24 may be inserted between the sheets 12 and 24, with the edge 30 of the ticket 24 engaged along the fold line 16 so that selected numbers in the spaces 28 are accessible through removed ones of the rectangular areas 20 in the template sheet 12. This is illustrated in FIG. 3, where one of the rectangular areas has been removed at 32, exposing the numeral 3 on the ticket 24.

To use the template, a lottery ticket 24 is inserted into the template with the edge 30 engaged fully into the fold 16 and the remaining edges of the ticket aligned with the edges of the sheets 12 and 14 of the template. The rectangular areas 20 corresponding to the numbers to be marked on the lottery ticket are then removed and a writing implement such as a pencil is used for marking the desired numbered areas on the ticket. The ticket can then be removed from the template and machine read in the usual way. If it is desired to keep the ticket, it may be stored in the template to protect it from damage. If the ticket has been damaged or lost, a new ticket can be inserted in the template and marked with the same numbers without difficulty.

While one embodiment of the present invention has been described in the foregoing it is to be understood that other embodiments are possible within the scope of the present invention. Thus, for example, it is possible to produce a template of a single sheet only where the template is to be used solely as a marking device and not for protective purposes.

The present invention is not therefore limited to the illustrated preferred embodiment. The scope of the invention should be ascertained solely by reference to the accompanying claims.

We claim:

1. A template for use with a user-marked lottery ticket, comprising a rectangular bottom sheet of transparent plastic material having substantially the same size and shape as the lottery ticket and a rectangular top sheet of the same transparent plastic material as the bottom sheet, having the same size as the bottom sheet and joined to the bottom sheet along a single fold line, the top sheet having a plurality of perforations therethrough outlining removeable rectangular areas of the template, the removeable areas being arranged in columns and rows and corresponding in number, position and form to user-markable spaces on the lottery ticket, the positional relationship between the removeable areas and the fold line being the same as the positional relationship between the user-markable spaces on the lottery ticket and a longitudinal edge of the ticket, whereby the template may be opened by unfolding the top and bottom sheets from one another about the fold line, inserting the lottery ticket between the top and bottom sheets with the longitudinal edge of the ticket engaged with the fold line and end edges of the ticket in registry with end edges of the template, and the template may be closed, leaving the ticket captured therein with the user-markable spaces in registry with the removeable areas of the top sheet, and both sides of the ticket visible through the transparent template.

2. A template according to claim 1 where each removeable area is confined between two confronting U-shaped perforations and is joined to the remainder of the top sheet by two frangible segments of the sheet between the confronting ends of the U-shaped perforations.

* * * * *